United States Patent [19]

Bednar

[11] 3,978,527

[45] Sept. 7, 1976

[54] HEADGEAR

[76] Inventor: Vladimir Bednar, Mullerwis 27, 8606 Greifensee (Kt. Zurich), Switzerland

[22] Filed: Nov. 25, 1974

[21] Appl. No.: 526,712

[30] Foreign Application Priority Data

Nov. 30, 1973 Switzerland ..... 16814/73

[52] U.S. Cl. ..... 2/68

[51] Int. Cl.[2] ..... A42B 1/12

[58] Field of Search ..... 2/68, 3 R; 9/346, 345, 9/333

[56] References Cited

UNITED STATES PATENTS

| | | | |
|---|---|---|---|
| 1,426,402 | 8/1922 | Moore | 2/68 X |
| 2,664,567 | 1/1954 | Nichols | 2/3 R |
| 2,726,398 | 12/1955 | Cooper | 2/68 |
| 2,766,466 | 10/1956 | Johns | 9/333 |
| 3,510,880 | 5/1970 | Gerson | 2/68 |
| D80,930 | 4/1930 | Bauman | 2/68 X |

FOREIGN PATENTS OR APPLICATIONS

| | | | |
|---|---|---|---|
| 1,382,312 | 11/1964 | France | 2/68 |
| 332,452 | 10/1958 | Switzerland | 2/3 R |
| 947,772 | 1/1964 | United Kingdom | 2/3 R |

*Primary Examiner*—Alfred R. Guest
*Attorney, Agent, or Firm*—Karl F. Ross; Herbert Dubno

[57] ABSTRACT

A bathing or protective headgear capable of providing flotation or cushioning of blow comprises a cap with an inflatable compartment and a chin strap which is also inflatable or buoyant and can communicate at one end with the interior of the cap while the other end is formed with a detachable fastener.

5 Claims, 12 Drawing Figures

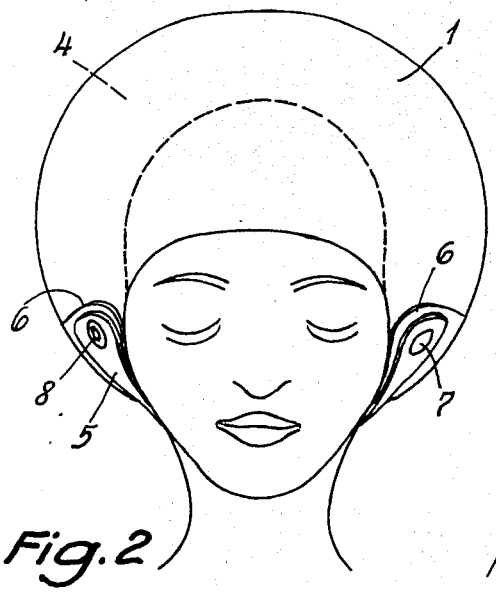
Fig. 2
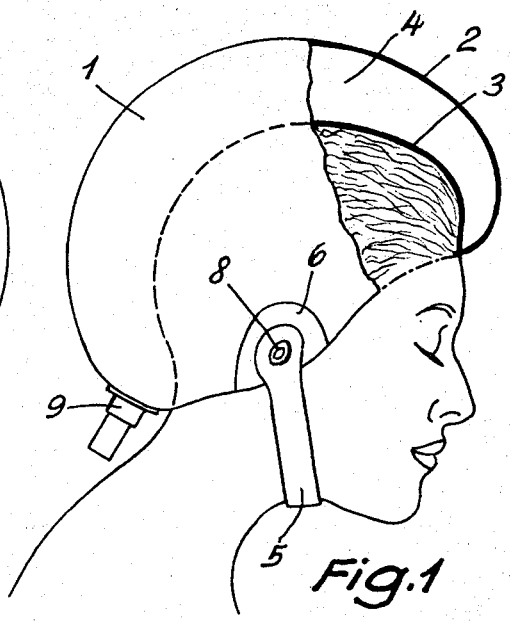
Fig. 1
Fig. 3
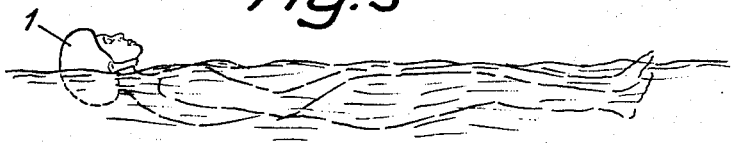
Fig. 5
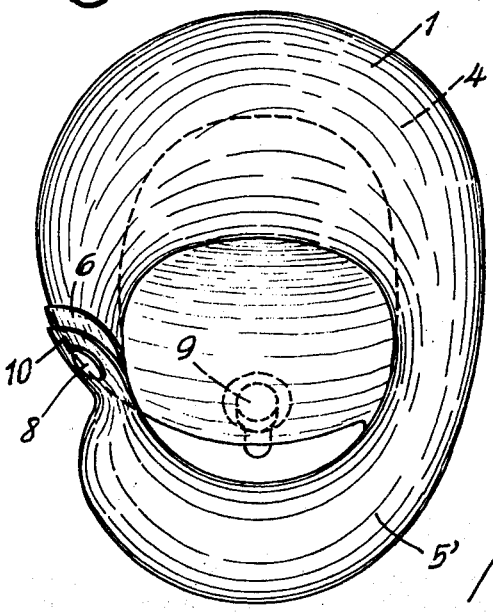
Fig. 4
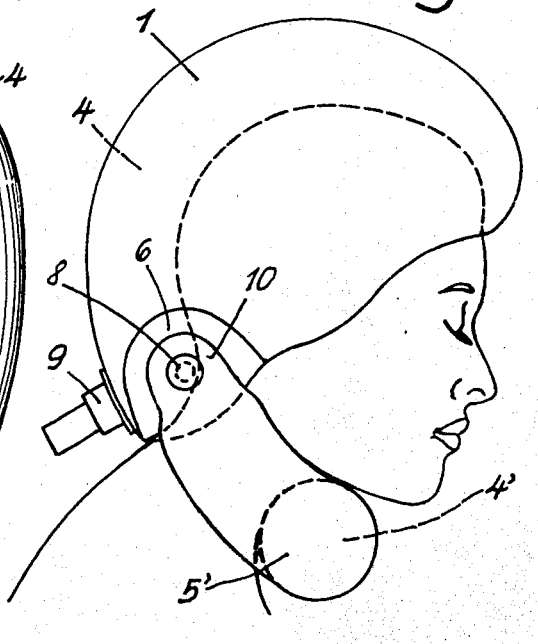

HEADGEAR

This invention relates to headgear which can be used as a swimming aid or for protection against cold or against injuries by sportsmen, and which differs from headgear of the type known heretofore in that it has an inflatable cap of pliant material with a double wall enclosing a hermetically sealed cavity.

As a swimming aid the cap satisfies a real need, expecially for beginners who are insecure or lack endurance, in particular when swimming on the back it ensures that water is kept out of the mouth and nose. At the same time the cap prevents water from getting into the ears. When swimming on the back, small movements with the hands and feet are sufficient to produce additional buoyancy, while corpulent swimmers can even lie motionless on the surface of the water. When fatigue ensues during normal breast stroke swimming over long distances or in heavy seas, relief and relaxation can be obtained by floating on one's back. In cold water swimmers are often menaced by drowning as the result of cramp. Here again the swimmer can save himself by swimming on his back with easy movements which allow him to relax and recover from the attack. The cap is also a particularly effective aid to rescue swimmers, who adopt the back stroke to save drowning persons.

Sportsmen, such as hockey players, skiers, motor and pedal cyclists, can wear a suitably heavier version of the cap as protection against mechanical injuries as well as cold. Depending on its use and purpose the cap may be given a fashionable and attractive appearance by plastic embossing, decorative trimmings and color effects, or it may be used for advertising purposes with appropriate lettering and/or graphic designs.

In the drawing:

FIG. 1 is a side view partially in section of an inflatable cap worn as a swimming aid;

FIG. 2 is a front view thereof;

FIG. 3 shows a person swimming on his back with the help of the cap;

FIG. 4 is a second version of the cap viewed from the side;

FIG. 5 is a front view of the cap shown in FIG. 4;

Figure 7:
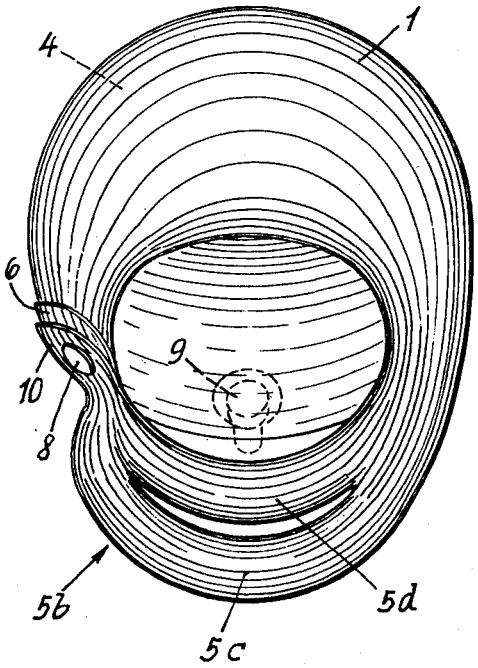
FIG. 7 is a front view of the cap shown in FIG. 6.

Referring now to FIGS. 1 and 2, the headgear is designed as a double-walled cap 1, which may consist of, say, rubber or of a soft elastic plastic (synthetic resin) film. The cap differs from conventional designs in particular by the fact that the inner and outer walls 2 and 3 enclose a hermetically sealed and inflatable cavity 4. As on familiar bathing caps there is a chin strap 5 permanently fastened at one side with a rivet 7 onto a reinforced part 6, and at the other side disconnectably attached with a press stud 8 onto the reinforced part 6. At the back of the cap 1 there is a closable valve 9 communicating with the cavity bounded by the walls 2 and 3 and allowing air to be forced in or discharged. When discharged the cap can be laid flat and doubled back on itself. The valve may also be arranged elsewhere instead of at the back, for example at the side.

FIG. 3 shows a person swimming on his back with the cap inflated as a swimming aid. Experience gathered during swimming lessons confirms that a person swimming on his back can keep himself afloat in a horizontal position on the surface with weak swimming movements, say, of the feet, as long as his head is supported. This support is given by the inflated swimming cap. It enables the swimmer to relax in a lying posture while making small movements with the limbs.

In the second form of the inflatable cap 1 according to FIGS. 4 and 5, the chin strap consists of a tubular extension 5*a* which is integral with the cap and is arranged at one side thereof, its cavity 4*a* communicating with that of the cap. At its free end the hollow chin strap 5*a* terminates in a flat tab 10. This tab 10 is releasably fastened to a reinforced part 6 on the other side of the cap with a press stud 8. When the cap is inflated, the tubular chin strap 5*a* is also filled with air, so as to increase the buoyancy accordingly. Furthermore the inflated chin strap 5*a* tends to raise the chin and therefore to tilt back the head of the swimmer, so that the mouth and nose are kept above water. This is of benefit when swimming, say, with the breast stroke, but particularly if a swimmer is unable to perform the movements of swimming any longer due to some indisposition (e.g. cramp).

Chin strap 5 shown in FIG. 1 can also be made hollow with an air filling, like chin strap 5*a* in FIG. 4. Alternatively it is possible to subdivide the cavity bounded by the walls 2 and 3, as well as the chin strap, into a number of compartments. This has the advantage that the cap still provides buoyancy and protection should one of the walls 2 or 3 happens to leak in some place. If the compartments are to be deflated in order to put the cap away, each compartment must then be fitted with an air valve. For a cheaper embodiment, however, it is also possible to have the compartments permanently sealed after filling them with air at the time of manufacture.

In the form illustrated in FIGS. 6 and 7, the chin strap 5*b* comprises two tubular cavities 5*c* and 5*d*, of which the lower cavity 5*c* is designed to rest below against the chin, while the cavity 5*d* projecting beyond cavity 5*c* is preferably so shaped as to rest in front against the chin in the curvature between mouth and chin, when the cap is worn and the chin strap 5*b* is fastened. With the modified form shown in FIGS. 6 and 7, the tendency to keep the mouth and nose above the water level by lifting the chin of the swimmer and tilting his head back is still greater than with the form shown in FIGS. 4 and 5.

Figure 6:
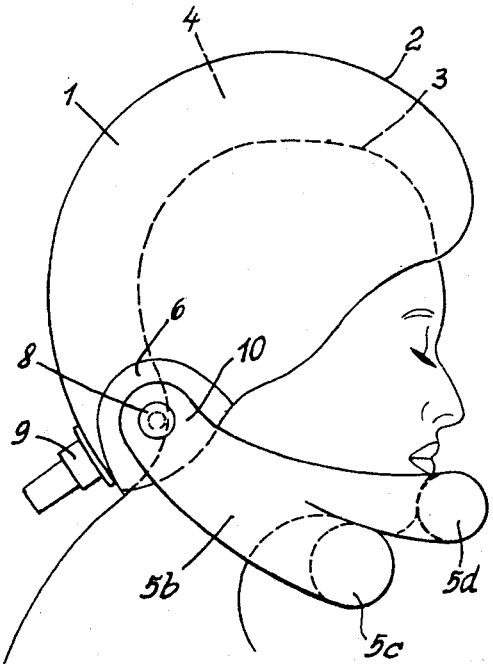
FIG. 6 illustrates a third form of the cap as a swimming aid, viewed from the side.
Figure 9:
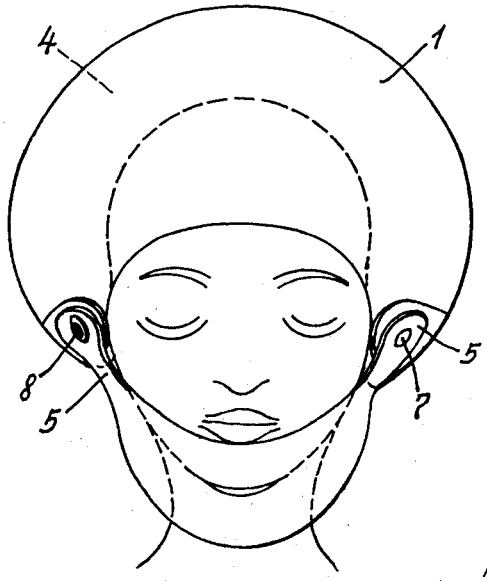
FIG. 9 is a front view of the cap shown in FIG. 8.
Figure 8:
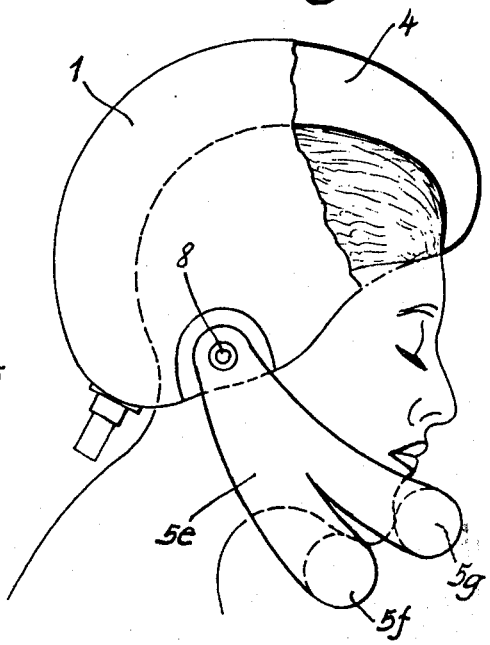
FIG. 8 illustrates a fourth form of the cap, again as a swimming aid, viewed from the side.

The next typical form shown in FIGS. 8 and 9 corresponds to that illustrated in FIGS. 6 and 7, except that the inflated chin strap 5*e*, 5*f*, 5*g* does not communicate with the cavity 4 of cap 1, but is designed as a separate buoyancy compartment. Chin strap 5*a* terminates at both sides in flat tabs 5, being permanently fixed to cap 1 at one side with the rivet 7, and disconnectably at the other side with a press stud 8. The form shown in FIGS. 8 and 9 gives the same effect as that illustrated in FIGS. 6 and 7. As a modification to the forms shown in FIGS. 6 through 9, however, the chin strap may consist of more than two inflatable tubular pieces, giving enhanced safety.

Figure 12:
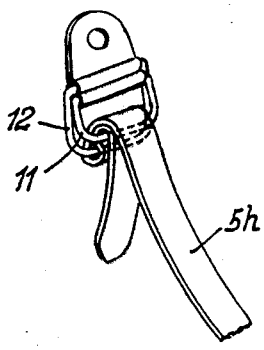
FIG. 12 shows a detail of FIG. 11 on an enlarged scale.
Figure 11:
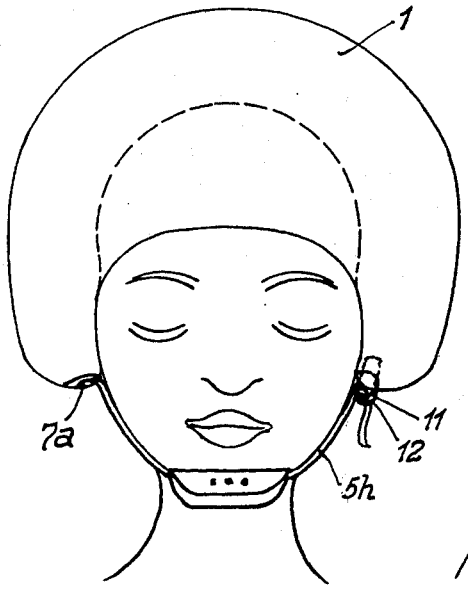
FIG. 11 is a front view of the helmet shown in FIG. 10.
Figure 10:
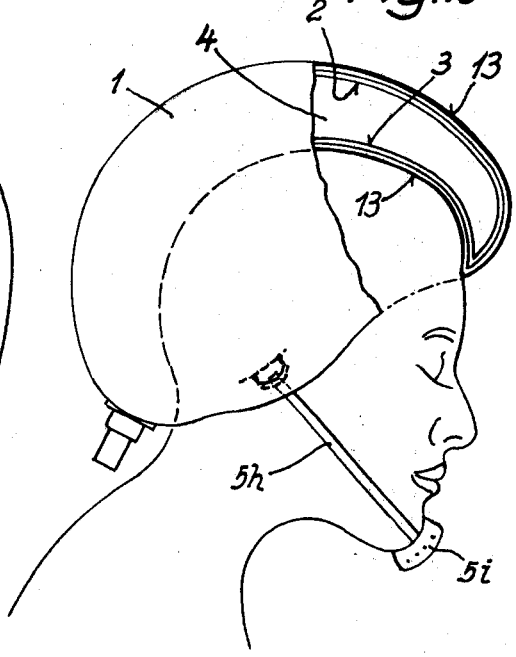
FIG. 10 is a fifth form of the inflatable cap usable as a protective helmet.

The inflatable cap shown in FIGS. 11 to 12 is intended to be worn as a protective helmet. Once agian numeral 1 designates the cap, 2 the outer and 3 the inner wall thereof. There is an inflatable intermediate cavity 4, while 5*h* denotes the chin strap which is provided with a chin protector 5*i*. At one end the chin strap is permanently joined to the cap at 7*a*, while at the other end there is a disconnectable fastening to the cap by means of two halfrings 11 and 12 attached to the cap, as shown in FIG. 12. In contrast to the aforedescribed forms, in this case the cap walls 2 and 3 are covered on the outside with a durable textile fabric 13 as a protection against cold. This fabric may be of natural or man-made fibers.

Instead of the chin strap fastenings illustrated and described, it is understood that any other suitable closure may be used.

What I claim is:

1. A buoyant or protective headgear comprising:

a double-wall cap adapted to fit over the head of a wearer and formed with an inflatable compartment;

a tubular chin strap affixed to said cap at one end thereof and communicating with said compartment for inflation upon inflation of said compartment, said chin strap being adapted to engage a front portion of the head of the wearer in the region of the chin thereof;

detachable fastening means on the other end of said chin strap and said cap for releasably connecting said other end of said chin strap to said cap; and valve means communicating with said compartment and enabling inflation and deflation of said cap and said chin strap.

2. A buoyant or protective headgear comprising:

a double-wall cap adapted to fit over the head of a wearer and formed with an inflatable compartment;

a tubular chin strap affixed to said cap at one end thereof and communicating with said compartment for inflation upon inflation of said compartment, said chin strap being adapted to engage a front portion of the head of the wearer in the region of the chin thereof;

detachable fastening means on the other end of said chin strap and said cap for releasably connecting said other end of said chin strap to said cap; and valve means communicating with said compartment and enabling inflation and deflation of said cap and said chin strap, said chin strap being formed with a pair of independent tubular inflatable bulges positioned to enable one of said bulges to engage a front portion of the chin of the wearer and the other of said bulges to engage beneath the chin of the wearer.

3. A buoyant or protective headgear comprising:

a double-wall cap adapted to fit over the head of a wearer and formed with an inflatable compartment;

an inflatable tubular chin strap affixed to said cap at one end thereof, said chin strap being adapted to engage a front portion of the head of the wearer in the region of the chin thereof;

detachable fastening means on the other end of said chin strap and said cap for releasably connecting said other end of said chin strap to said cap; and valve means communicating with said compartment and enabling inflation and deflation of said cap and said chin strap, said chin strap being formed with a pair of independent tubular inflatable bulges positioned to enable one of said bulges to engage a front portion of the chin of the wearer and the other of said bulges to engage beneath the chin of the wearer.

4. The headgear defined in claim 3 wherein said bulges have cavities which communicate with each other.

5. The headgear defined in claim 3 wherein said compartment and said chin strap are separately inflatable.

* * * * *